US005274973A

United States Patent [19]

Liang

[11] Patent Number: 5,274,973

[45] Date of Patent: Jan. 4, 1994

[54] STUD SPACER AND MOUNTING SYSTEM

[76] Inventor: Steve S. T. Liang, 193-35 Nero Ave., Holliswood, N.Y. 11423

[21] Appl. No.: 798,733

[22] Filed: Nov. 27, 1991

[51] Int. Cl.[5] ..... E04B 2/08

[52] U.S. Cl. ..... 52/243; 52/317; 52/664; 52/667

[58] Field of Search ..... 52/243, 241, 721, 735, 52/660, 238.1, 664, 667, 317

[56] References Cited

U.S. PATENT DOCUMENTS

| | | | |
|---|---|---|---|
| Re. 28,976 | 8/1976 | Zinn | 52/243 X |
| Re. 29,965 | 4/1979 | Zinn | 52/243 |
| D. 203,133 | 12/1965 | Senek | D8/373 |
| 1,211,562 | 1/1917 | Edwards | 52/241 |
| 1,867,449 | 7/1932 | Ecket et al. | 52/317 X |
| 2,216,319 | 10/1940 | McGee | 52/243 |
| 2,235,761 | 3/1941 | Goldsmith | 52/241 |
| 2,275,109 | 3/1942 | McGee | 52/241 |
| 2,371,921 | 3/1945 | Tucker | 189/34 |
| 3,423,893 | 1/1969 | Hyatt | 52/241 |
| 3,536,345 | 10/1970 | Leifer | 52/241 X |
| 3,604,176 | 9/1971 | Campbell | 52/735 X |
| 3,680,271 | 8/1972 | Satchell | 52/241 X |
| 3,908,328 | 9/1975 | Nelsson | 52/735 |
| 4,007,570 | 2/1977 | Hunter | 52/317 |
| 4,075,810 | 2/1978 | Zakrzewski et al. | 52/667 X |
| 4,087,944 | 4/1978 | Mecklenburg | 52/241 |
| 4,672,785 | 6/1987 | Salvo | 52/241 |
| 4,805,364 | 2/1989 | Smolik | 52/241 |
| 4,809,476 | 3/1989 | Satchell | 52/241 |
| 4,850,169 | 7/1989 | Burkstrand | 52/243 X |
| 5,150,885 | 9/1992 | Leone | 52/667 X |

*Primary Examiner*—Carl D. Friedman
*Assistant Examiner*—Robert Canfield
*Attorney, Agent, or Firm*—Michael I. Kroll

[57] ABSTRACT

A stud spacer and mounting system is provided which consists of a plurality of studs, an elongated track member is positioned upon a flat horizontal surface, whereby the track member will substitute for a bottom sole plate. A structure is on the track member, for positioning and retaining the studs vertically in stationary spaced apart locations therealong, so that sheet rock boards can be secured flush to the studs when a wall is being constructed.

1 Claim, 3 Drawing Sheets

STUD SPACER AND MOUNTING SYSTEM

BACKGROUND OF THE INVENTION

1. Field of the Invention

The instant invention relates generally to stud locating tools and more specifically-it relates to a stud spacer and mounting system.

2. Description of the Prior Art

Numerous stud locating tools have been provided in prior art that are adapted to be used for measuring the proper locations along preexisting walls for the studs to be secured thereto. While these units may be suitable for the particular purpose to which they address, they would not be as suitable for the purposes of the present invention as heretofore described.

SUMMARY OF THE INVENTION

A primary object of the present invention is to provide a stud spacer and mounting system that will overcome the shortcomings of the prior art devices.

Another object is to provide a stud spacer and mounting system that is primarily a labor saying device which permits studs to be mounted without being measured by a carpenter to exact standards which is normally sixteen inches on center or other lengths as needed.

An additional object is to provide a stud spacer and mounting system in which track members are utilized with the stud locations built into the track members, so that when sheet rock boards are mounted to the studs the sheet rock will be mounted flush thereto without any bending.

A further object is to provide a stud spacer and mounting system that is simple and easy to use.

A still further object is to provide a stud spacer and mounting system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1A:
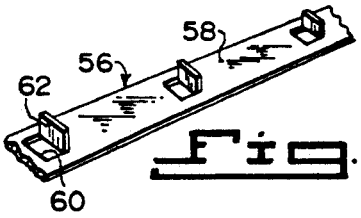
FIG. 1A is a perspective view of a portion of the tie truck as shown in phantom in FIG. 1.
Figure 1B:
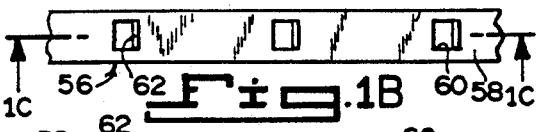
FIG. 1B is a top view of the tie truck.

Turning now descriptively to the drawings, in which similar reference characters denote similar elements throughout the several views, the FIGS. illustrate a stud spacer and mounting system 20, which comprises a plurality of studs 22. An elongated track member 24 is positioned upon a flat horizontal surface 26, whereby the track member 24 will substitute for a bottom sole plate. A structure 28 is on the track member 24, for positioning and retaining the studs 22 in vertically in stationary equally spaced apart locations as indicated by letter "A"therealong, so that sheet rock boards 30 can be secured flush to the studs 22 when a wall is being constructed.

As shown in FIGS. 1 through 5, each stud 22 is an elongated C-shaped metal channel 32. The elongated track member 24 is a U-shaped metal channel 34, sized so that each end of each elongated C-shaped metal channel 32 can fit into the U-shaped metal channel 34.

Figure 5:
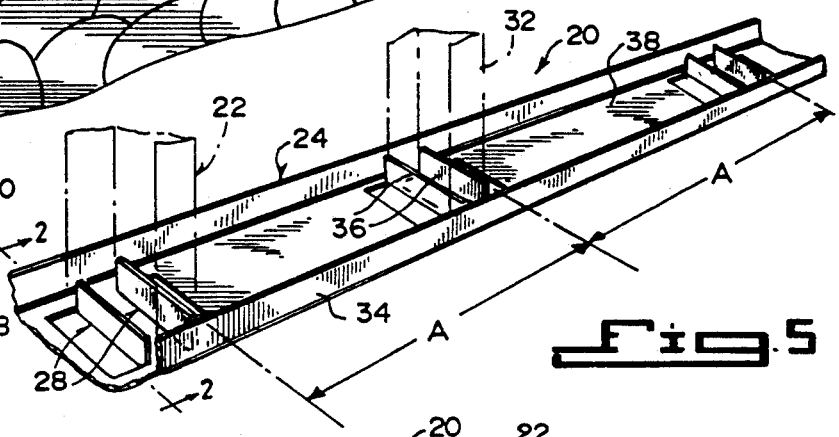
FIG. 5 is an enlarged perspective view of the first embodiment in greater detail.
Figure 3:
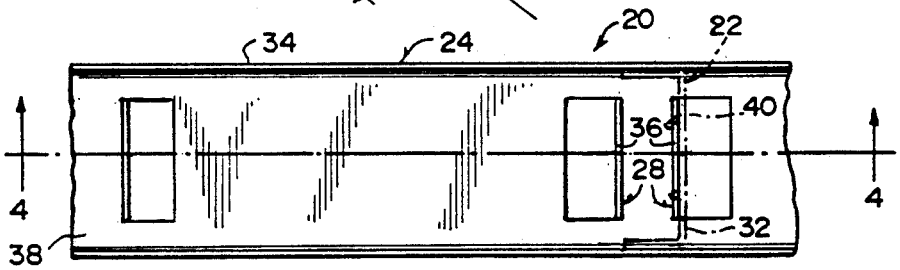
FIG. 3 is a top view thereof.
Figure 4:
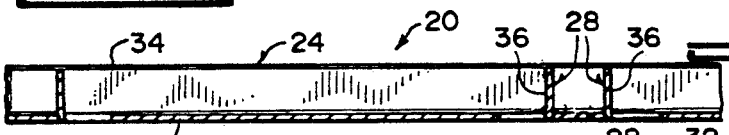
FIG. 4 is a cross sectional view taken along line 4—4 in FIG. 3.
Figure 4A:
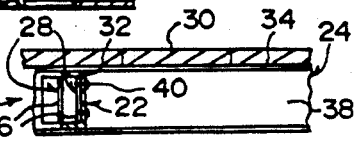
FIG. 4A is a diagrammatic top cross sectional view of the first embodiment in use.
Figure 6:
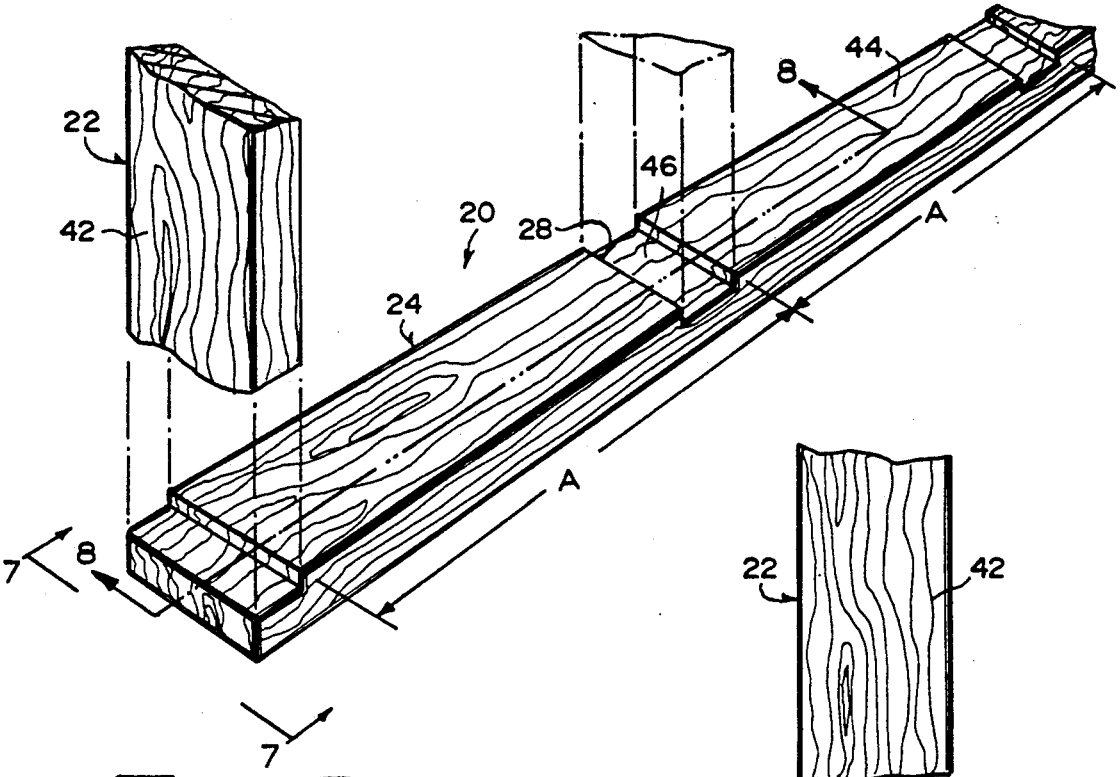
FIG. 6 is a perspective view of a second embodiment of the instant invention with the wooden studs broken away and in phantom thereon.
Figure 7:
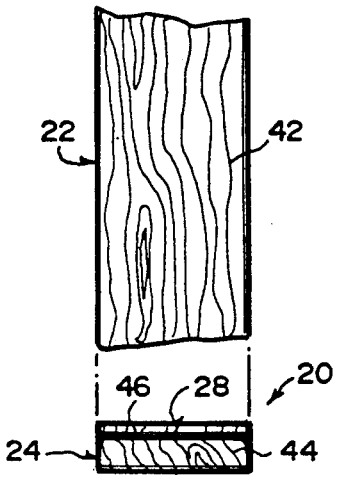
FIG. 7 is an end view taken in direction of line 7—7 in FIG. 6.
Figure 8:
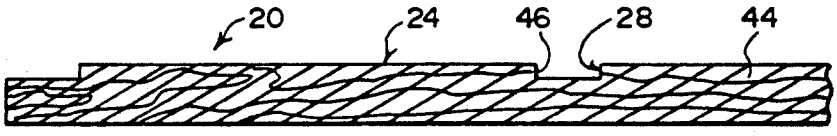
FIG. 8 is a cross sectional view taken along line 8—8 in FIG. 6.
Figure 9:
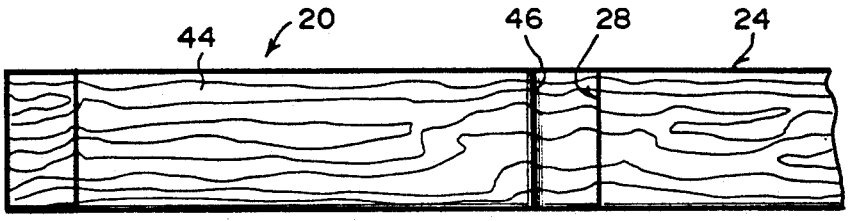
FIG. 9 is a top view thereof.
Figure 10:
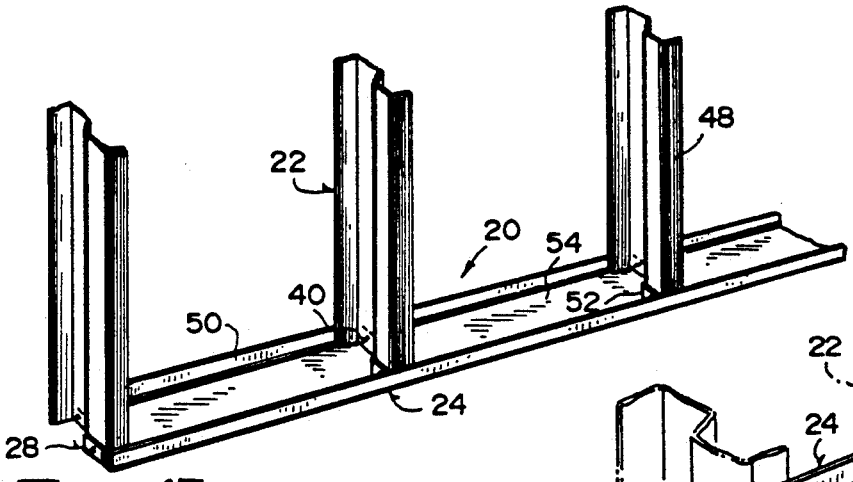
FIG. 10 is a perspective view of a third embodiment of the instant invention with the 2-shaped metal studs broken away thereon.
Figure 12:
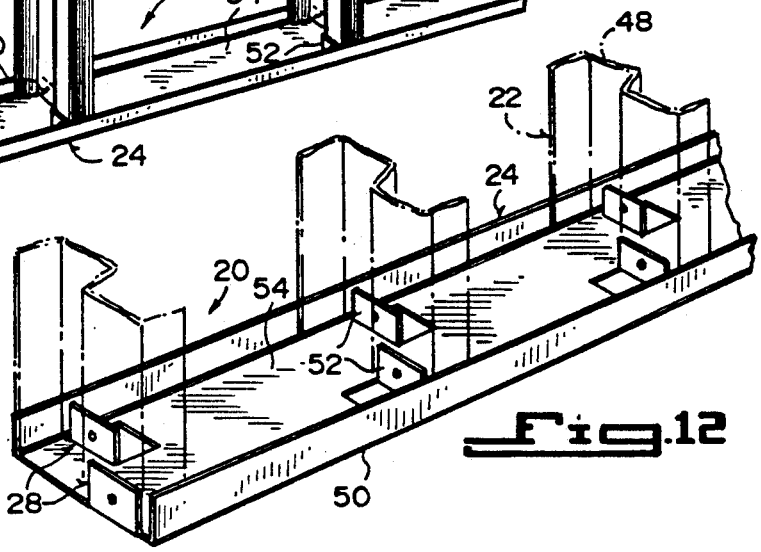
FIG. 12 is an enlarged perspective view of the third embodiment in greater detail.
Figure 11:
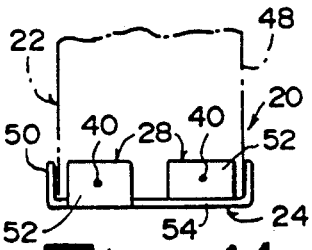
FIG. 11 is an end view thereof.
Figure 13:
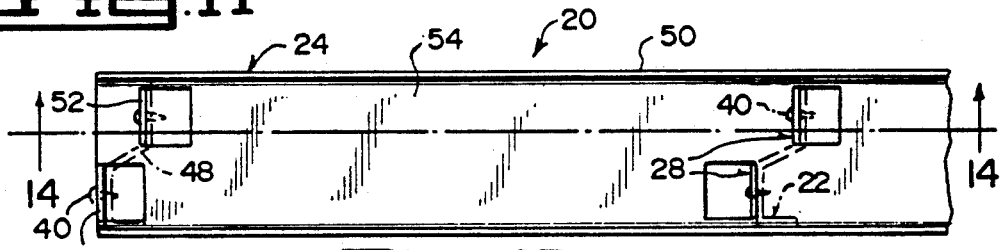
FIG. 13 is a top view thereof.
Figure 14:
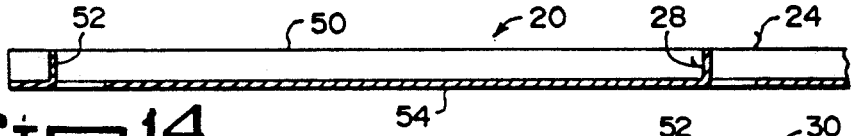
FIG. 14 is a cross sectional view taken along line 14—14 in FIG. 13.
Figure 14A:
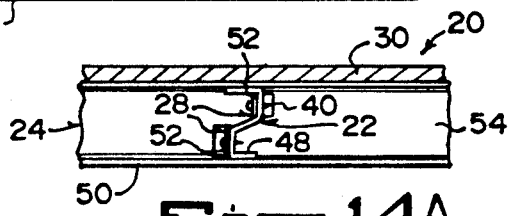
FIG. 14A is a diagrammatic top cross sectional view of the third embodiment in use.

The positioning and retaining mechanism 28 includes a plurality of upwardly extending flanges 36, each formed by punching and bending a portion of a base segment 38 of the U-shaped metal channel 34. Two flanges 36 are located at each of the equally spaced apart locations "A". In a first instance, as best shown in FIG. 3, the end of each elongated C-shaped metal channel 32 can be secured to one of the flanges 36 by fasteners 40. In a second instance, as best shown in FIG. 5, the end of each elongated C-shaped metal channel 32 can be secured between two of the flanges 36.

As shown in FIGS. 6 through 9, each stud 22 is an elongated rectangular shaped wooden board 42. The elongated track member 24 is an elongated rectangular shaped wooden board 44, being of the same size as each stud 22. The positioning and retaining mechanism 28 includes the elongated track member 24 having a plurality of transverse slots 46, with each slot 46 located at each of the equally spaced apart locations "A", so that the end of each stud 22 can fit into each slot 46 to be secured thereto.

As shown in FIG. 10 through 15, each stud 22 is an elongated 2-shaped metal channel 48. The elongated track member 24 is a U-shaped metal channel 50 sized so that each end of each elongated 2-shaped metal channel 48 can fit into the U-shaped metal channel 50.

The positioning and retaining mechanism 28 includes a plurality of upwardly extending flanges 52, formed by punching and bending a portion of a base segment 54 of the U-shaped metal channel 50. Two flanges 52 are located diagonally across from each other at each of the equally spaced apart locations "A", so that the end of each elongated 2-shaped metal channel 48 can be secured between two of the flanges 52 by fasteners 40.

Figure 15:
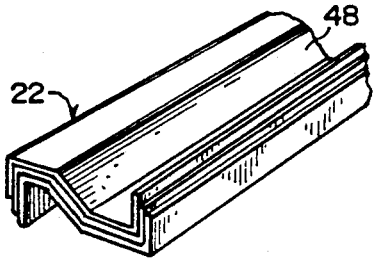
FIG. 15 is a perspective view of the 2-shaped metal studs in a stacked stored relationship.

The studs 22 when in the configuration of the elongated 2-shaped metal channels 48. they can be stacked and stored in a more compact condition, as shown in FIG. 15, than either the elongated C-shaped metal channels 32 or the elongated rectangular shaped wooden boards 42.

Figure 1C:
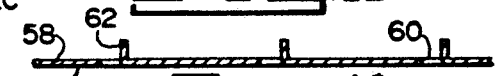
FIG. 1C is a cross sectional view taken along line 1C—1C in FIG. 1B.
Figure 1:
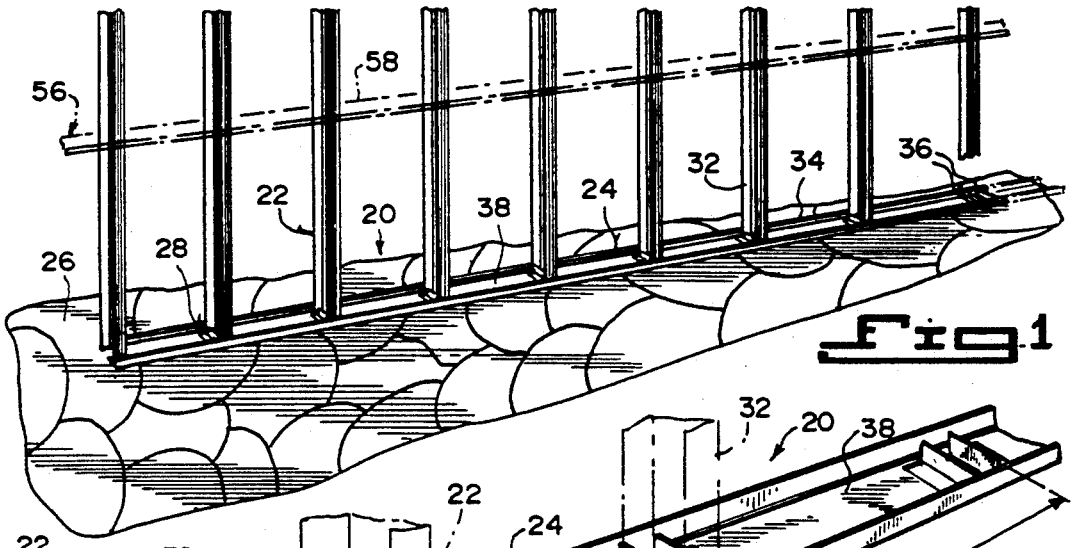
FIG. 1 is a perspective view with parts broken away showing a first embodiment of the instant invention with C-shaped metal studs thereon.
Figure 2:
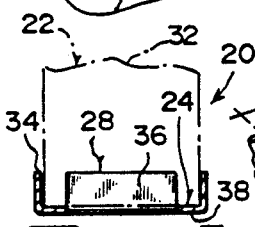
FIG. 2 is a cross sectional view taken along line 2—2 in FIG. 5.

As shown in FIGS. 1 through 1C, the stud spacer and mounting system 10 can further include a tie truck 56 extending horizontally above the track member 24 to keep the studs 22 stabilized vertically in the stationary equally spaced apart locations "A". The tie truck 56 is an elongated metal rectangular plate 56 having a plurality of apertures 60. Each aperture 60 is formed by punching and bending a portion of the plate 56 upwardly as a flange 62, in which one aperture 60 is located at each of the equally spaced locations "A". Each elongated C-shaped metal channel 32 will extend through one aperture 60 and can be secured to the respective flange 62. The tie truck 56 can also be used for stabilizing in the same manner the elongated rectangular shaped wooden boards 42 and the elongated 2-shaped metal channels 48.

The equally spaced apart locations "A"between the studs 22 are typical but not limited to be approximately sixteen inches on center. Other lengths than the sixteen inches can be utilized as needed. The fasteners 40 can be either nails, screws or rivets.

To assemble the stud spacer and mounting system 20, the following steps should be taken:

1. Measure and cut the elongated track member 24 to the proper length size of the wall being assembled.
2. Secure the elongated track member 24 to the flat horizontal surface 26.
3. Place each stud 22 at each positioning and retaining mechanism 28 in a vertical position.
4. The fasteners 40 Can then be inserted to secure the studs 22 to the elongated track member 24.
5. The completion of the wall can then be made, so that the sheet rock boards 30 can be secured flush to the studs 22.

| LIST OF REFERENCE NUMBERS | |
|---|---|
| A | equally spaced apart locations |
| 20 | stud spacer and mounting system |
| 22 | stud |
| 24 | elongated track member |
| 26 | flat horizontal surface |
| 28 | positioning and retaining mechanism |
| 30 | sheet rock board |
| 32 | elongated C-shaped metal channel for 22 |
| 34 | U-shaped metal channel for 24 |
| 36 | flange on 34 |
| 38 | base segment of 34 |
| 40 | fastener |
| 42 | elongated rectangular shaped wooden board for 22 |
| 44 | elongated rectangular shaped wooden board for 24 |
| 46 | transverse slot in 44 |
| 48 | elongated 2-shaped metal channel for 22 |
| 50 | U-shaped metal channel for 24 |
| 52 | flange on 50 |
| 54 | base segment of 50 |
| 56 | tie truck |
| 58 | elongated metal rectangular plate |

-continued

| LIST OF REFERENCE NUMBERS | |
|---|---|
| 60 | aperture in 58 |
| 62 | flange on 58 at 60 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and is desired to be protected by Letters Patent is set forth in the appended claims:

1. A stud spacer and mounting system for a wall which comprises:

a) a plurality of studs whereby each said stud is an elongated C-shaped homogeneous metal channel;

b) an elongated track member positioned upon a flat horizontal surface, whereby said track member will substitute for a bottom sole plate, said elongated track member being a U-shaped homogeneous metal channel having ends and sized so that each end of each said elongated C-shaped homogeneous metal channel can fit into said U-shaped homogeneous metal channel, said U-shaped homogeneous metal channel being homogeneous so that for all intent and purposes it will keep the wall perfectly straight;

c) means on said track member for positioning and retaining said studs vertically in stationary equally spaced apart locations therealong so that sheet rock boards can be secured flush to said studs when the wall is being constructed, said positioning and retaining means includes a plurality of upwardly extending flanges, each formed by punching and bending a portion of a base segment of said U-shaped homogeneous metal channel, in which two of said plurality of upwardly extending flanges are located at each of the equally spaced apart locations so that in a first instance an end of each said elongated C-shaped homogeneous channel can be secured to one of said flanges and in a second instance an end of each said elongated C-shaped homogeneous metal channel can be secured between two of said flanges; and d) a tie truck being homogeneous and the approximate length of a corresponding said U-shaped homogeneous metal channel, said homogeneous tie truck extending horizontally above said track member to keep said studs stabilized vertically in the stationary equally spaced apart locations, said tie truck includes an elongated homogeneous metal rectangular plate having a plurality of apertures, each formed by punching and bending a portion of said plate upwardly as a flange in which one said aperature is located at each of the equally spaced locations so that each said elongated C-shaped homogeneous metal channel will extend through one said aperture and can be secured to said respective flange, said homogeneous tie truck going over said C-shaped homogeneous metal channels so that for all intent and purposes it will help keep the wall perfectly straight as opposed to individual braces between each pair of said C-shaped homogeneous metal channels which can cause the wall to waiver.

* * * * *